United States Patent [19]

Sung et al.

[11] 4,169,799

[45] Oct. 2, 1979

[54] LUBRICATING OIL COMPOSITION

[75] Inventors: Rodney L. Sung, Fishkill; Benjamin H. Zoleski, Beacon, both of N.Y.

[73] Assignee: Texaco Inc., White Plains, N.Y.

[21] Appl. No.: 754,658

[22] Filed: Dec. 27, 1976

[51] Int. Cl.[2] ..... C10M 1/54; C10M 3/48; C10M 5/28; C10M 7/52

[52] U.S. Cl. ..... 252/42.7; 252/48.4; 252/393; 252/46.7

[58] Field of Search ..... 252/33, 42.7, 48.4, 252/393

[56] References Cited

U.S. PATENT DOCUMENTS

| | | | |
|---|---|---|---|
| 3,367,867 | 2/1968 | Abbott et al. | 252/42.7 |
| 3,377,281 | 4/1968 | Gower | 252/33 |
| 3,474,035 | 10/1969 | Dadura | 252/42.7 |
| 3,528,917 | 9/1970 | Dadura et al. | 252/42.7 |
| 3,562,159 | 2/1971 | Mastin | 252/33 |
| 3,761,414 | 9/1973 | Haugen et al. | 252/42.7 |
| 3,775,321 | 11/1973 | Turnquest et al. | 252/42.7 |
| 3,969,235 | 7/1976 | Sung et al. | 252/42.7 |
| 4,010,106 | 3/1977 | Rothert | 252/42.7 |
| 4,016,093 | 4/1977 | Koft | 252/42.7 |

*Primary Examiner*—Delbert E. Gantz
*Assistant Examiner*—Irving Vaughn
*Attorney, Agent, or Firm*—Thomas M. Whaley; Carl G. Ries; James J. O'Loughlin

[57] ABSTRACT

Lubricant oil comprising a hydrocarbon oil of lubricating viscosity, a highly overbased alkaline earth metal-containing alkylphenolate detergent-dispersant composition sufficient to impart a total base number to said lubricant oil of at least 10; and a chlorinated sulfurized alkylphenol.

20 Claims, No Drawings

LUBRICATING OIL COMPOSITION

BACKGROUND OF THE INVENTION

This invention occurs in the field of art involving, generally, lubricating oils adapted for use between a plurality of relatively moving surfaces with which the fluid compositions are in contact for the purpose of reducing the friction between these surfaces while providing protection, concomitantly, from wear and corrosion. These fluid compositions or lubricating oils, tend to deteriorate under conditions of use in present day diesel engines with attendant formation of sludge, lacquer and resinous materials which adhere to the engine parts; particularly the piston ring, groove and skirt, thus reducing the operating efficiency of the engine. To counteract the formation of these deposits, certain chemical additives have been found which when added to lubricating oils have the ability to keep the deposit forming materials suspended in oil so that the engine is kept clean and in efficient operating condition for extended periods of time. These agents are known in the art to which this invention pertains as detergents, dispersants or detergent-dispersants. Metal organic compounds are particularly useful in this respect. One class of metal organic compounds which has been found so useful are the sulfurized normal and overbased calcium alkylphenolates. These agents are believed to be effective because they provide alkalinity capable of neutralizing strong organic and inorganic acids and are capable of dispersing deposits and deposit precursors into the oil phase. Overbased sulfurized metal alkylphenolates have been found to be particularly effective dispersants in lubricating oils.

By the term "overbased" in this context is meant, generally, that the ratio of the number of equivalents of calcium metal to the number of equivalents of alkylphenolate moiety is greater than 1. The term "normal" indicates that the ratio of the number of equivalents of calcium metal to the number of equivalents of alkylphenolate moiety is 1. U.S. Pat. Nos. 3,528,917; 3,549,534; 3,761,414; and 3,969,235 describe lubricating compositions containing sulfurized normal calcium alkylphenolate detergent-inhibitors of improved resistance to oxidation. Sulfurized overbased calcium alkylphenolate additives of particular utility are those described in U.S. Pat. Nos. 3,474,935 and 3,706,632. The term "overbased" in the present instance is further defined to mean that the ratio of the number of calcium moiety to the number of equivalents of alkylphenolate moiety is at least 2.9:2; that is, a calcium metal to alkylphenolate ratio of at least 2.9:2. In contrast, many overbased sulfurized metal alkylphenolates having a calcium metal to alkylphenolate ratio greater than 1 and less than 2.9 have also proved to be useful lubricant additives heretofore.

Other useful detergent-inhibitor additives are the alkaline earth metal sulfonates, and preferably, calcium hydrocarbyl sulfonates wherein the hydrocarbyl sulfonate moiety is derived from a petroleum sulfonate.

It has been found recently that railway diesel engine oils having a high degree of alkalinity, that is, a TBN of at least 10 are particularly desirable in that they prevent corrosion by oil-soluble acids formed by oxidative deterioration at the high temperature existing under normal conditions of engine employment in proximity to the combustion chamber. The term "TBN" or "nominal "TBN" as employed herein refers to "total base number" which is defined as the quantity of acid, expressed in terms of the equivalent number of milligrams of potassium hydroxide that is required to neutralize all basic constituents present in one gram of a given sample. The method of evaluation is that defined as ASTM Method D 664.

While the desired alkalinity can be attained by introduction into the lubricant oil of a calcium sulfonate such as the foregoing having a nominal TBN of 290 or more of a sulfurized overbased calcium alkylphenolate having a calcium metal to alkylphenolate ratio of at least 2.9:2, the resulting lubricant compositions are unsatisfactory because these overbased materials degrade the silver protection characteristics of the oil, a factor of particular significance with respect to railway diesel engines, the vast majority of which, in the United States, and to a significant extent outside of the United States, as well, utilize silver-plated piston pin insert bearings.

Accordingly, the discovery of additives which would permit the use of a highly overbased calcium alkylphenolate and, when desired, a highly overbased alkaline hydrocarbyl sulfonate, as well, in lubricant oils for use in railway diesel engines in amounts sufficient to provide a TBN of at least 10, without diminution of the silver properties of the oil, would represent a significant advance in the state of the art.

SUMMARY OF THE INVENTION

We have discovered, and this constitutes generally, our invention, that an improved lubricant oil composition, substantially less susceptible to oxidative deterioration even at the elevated temperatures existing in proximity to the combustion chamber of a present day railway diesel engine, when in use, and protective of the silver components of the engine is secured using lubricant oil comprising a hydrocarbon oil of lubricating viscosity; as detergent-inhibitor (a) a sulfurized overbased calcium alkylphenolate wherein the calcium metal to alkylphenolate ratio is at least 2.9:2 or (b) in admixture, a sulfurized calcium alkylphenolate having a ratio of the number of equivalents of calcium metal to alkylphenolate of at least 1:2 and an overbased alkaline earth metal hydrocarbyl sulfonate having a TBN of at least 50; together with a chlorinated sulfurized alkylphenol substantially free of polysulfides.

DETAILED DESCRIPTION OF THE INVENTION

More particularly, this invention is directed to a lubricating oil composition comprising (1) a hydrocarbon oil of a lubricating viscosity, (2) as a detergent-inhibitor (a) a sulfurized overbased calcium alkylphenolate wherein the calcium metal to alkylphenolate ratio is at least 1:2 more desirably 1:2 to 1.1:2; and from 2.9:2 to 3.5:2; and preferably 1:2 and 3:2, and is prepared as described hereinafter; or (b) in admixture, sulfurized calcium alkylphenolate having a ratio of equivalents of calcium metal to alkylphenolate as recited and prepared as described hereinafter, and an overbased alkaline earth metal hydrocarbyl sulfonate having a TBN of at least 50, desirably, from 50 to 500, more desirably from 290 to 400 and preferably about 290; and also prepared as described hereafter; together with a sulfurized and chlorinated alkylphenolate additive substantially free of polysulfide and having a chlorine content by weight of at least 0.5 percent and from 0.5 percent to 5 percent;

and usually about 1.7 percent by weight; and a sulfur content by weight of at least 1.5 percent; and within the range of 1.5 percent to 4.0 percent.

The sulfurized overbased calcium alkylphenolate, sulfurized normal calcium alkylphenolate (employed in combination with the foregoing alkaline earth metal hydrocarbyl sulfonate) and the sulfurized and chlorinated alkylphenolate are prepared by a sequence of steps the first several of which are similar.

The sulfurized calcium alkylphenolate detergent-inhibitors for use herein are those having a mole ratio of calcium metal to alkylphenolate ratio of at least 1 to 2 and not in excess of 3.5 to 2; and prepared generally by a sequence of steps that comprises contacting, in the presence of a lubricating oil of an alkylphenol of the formula:

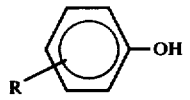

(I)

wherein R represents 1 or 2 monovalent saturated aliphatic hydrocarbon or alkyl radicals, each of from 4 to 50 carbons, and preferably 10 to 15 carbon atoms, and where, in said alkylphenol; at least one ortho or para position remains unsubstituted, with calcium alkoxyalkoxide of the formula:

$$CA\text{-}(O\text{—}A\text{—}OR')_2 \quad \text{(II)}$$

wherein A is a divalent saturated aliphatic hydrocarbon radical (alkanediyl) of 1 to 6 carbon atoms and R' is an alkyl radical of from 1 to 25, and preferably 1 to 4 carbon atoms inclusive; said contact being effected at a temperature of from 50° F. to 425° F., and more desirably 200° F. to 425° F., in one step or two steps; and utilizing a mole ratio of calcium alkoyalkoxide to said alkylphenol in said one step or in the total of said two steps of from 0.5:1 to 0.6:1; introducing sulfur at a temperature of from 165° F. to 460° F., and preferably 410° F. to 450° F., after the first of said foregoing steps, into contact with the resulting reaction mixture; utilizing a mole ratio of sulfur to initial alkylphenol of between 0.5:1 and 0.8:1, and in the presence of a hydrocarbon lubricating oil, said hydrocarbon oil constituting between about 13 percent and 20 percent by weight of said reaction mixture; to effect incorporation in said alkylphenolate of from 2 percent to 6 percent by weight of sulfur; and, where an overbased product, that is, one having a calcium metal to alkylphenolate ratio of at least 2.9:2, more desirably 2.9:2 to 3.5:2, and preferably 3:2, is being prepared for use in accordance with the invention, a further reaction mixture is formed by introducing into said immediately preceding reaction mixture, comprising a substantially normal (i.e. up to 10 percent overbased) sulfurized calcium alkylphenolate, a further addition of a calcium alkoxyalkoxide of said formula (II) at a temperature within said first temperature range, in a mole ratio of 0.5:1 to 1:1 of said calcium alkoxyalkoxide to initial alkylphenol; and thereafter sequentially hydrolyzing said resulting reaction mixture and contacting the resulting hydrolyzed product with carbon dioxide.

Particular embodiments of the present invention involve more particularly, a sequence of steps the first of which is directed to contacting of the reactants of formulae (I) and (II) hereinabove in a lubricating oil in which they are reacted at a temperature of between about 320° F. and 425° F. in a mole ratio of calcium alkoxyalkoxide to alkylphenolate of between 0.225:1 and 0.45 to 1. The reaction is conducted until essentially all of the alkoxyalkoxide is reacted; a period generally of from about 0.5 to about 8 hours, to form the first calcium alkylphenolate reaction product.

As a second stage or step, the resulting first reaction product is contacted, after removal of volatile solvent (where present), with sulfur at a temperature between 440° F. and 460° F., and preferably about 450° F., in the presence of between about 13 and 20 weight percent (wt.%) of a hydrocarbon lubricating oil of an SUS viscosity of between 50° and 2,500° at 100° F. utilizing a mole ratio of sulfur to initial alkoxyphenol respectively, of between 0.5 to 1 and 8 to 1; and preferably between about 0.5:1 to 3:1, to form a second reaction mixture. During this addition of sulfur there is passed through this second reaction mixture, sequentially, inert gas, carbon dioxide, and inert gas, the latter preferably nitrogen, until no detectible hydrogen sulfide ($H_2S$) odor is found, which is normally measured at less than 3 parts per million (ppm) $H_2S$, and a copper strip corrosion employing ASTM D-130 of a 2 A maximum (3hours - 212° F.). An inert carbon dioxide gas rate of between about 0.1 to 10 standard cubic feed per hour per gallon (SCFH/gallon) is advantageously employed. The carbon dioxide functions as a deodorizing agent whereas the inert gas functions to facilitate removal of volatile components in the reaction mixture. The reaction time in this second step or stage is generally between 0.5 hours and 10 hours. The resulting second reaction product is a sulfurized calcium alkylphenolate mixture having a sulfur content between 0.1 and 10 weight percent.

The gas blown second reaction product mixture, upon completion of the sulfurization step, is then contacted in a third step with a second quantity of a calcium alkoxyalkoxide of general formula (II) above, at a temperature between about 350° F. and 425° F., and preferably about 370° F., utilizing from 0.15 moles to 0.375 moles, of calcium alkoxyalkoxide per mole of original alkylphenol reactant, the first and second additions of calcium alkoxyaloxide totalling about 0.6 moles and between 100 percent and 120 percent of stoichiometric. The reaction time of this third stage is generally between about 0.5 and 8 hours. An inert gas flow, preferably of nitrogen, is introduced directly into the reaction mixture in this, as in the other addition stages recited herein (unless otherwise expressly indicated), preferably through the bottom of the reactor from where it is passed through the liquid in upward flow with continuous removal of the gas from the upper region of the reactor system. The nitrogen (or other inert gas), introduced at a rate of from 0.1 to 10 SCFH/gallon, exerts a positive pressure in the reactor system of between 1 and 4 p.s.i.g. This method, a standard one, is that employed preferably and normally in the other stages where gas transmission through a reaction mixture is described herein. Further, agitation is employed normally in all stages of the procedure in order to facilitate ingredient contact.

The third reaction product secured is a crude mixture of the sulfurized normal calcium alkylphenolate, wherein the number of equivalents of alkylphenolate to the number of equivalents of calcium is 1.

This mixture is stripped by continuing the inert gas flow, which is preferably nitrogen, as before, at a rate between about 0.25 and 0.6 SCFH/gallon at a temperature between about 150° C. and 200° C., permitting the low boiling volatile materials to be removed, such as 2-methoxyethanol, the usual solvent employed with the calcium alkoxyalkoxide reactant and entered into the raction mixture therewith. Stripping, as described with respect to the various stages of the present process, does not, however, affect removal of the diluent oils introduced in the individual steps of the process.

This third reaction product, a crude mixture of substantially normal sulfurized calcium alkylphenolate provides, after stripping and filtration, a preferred phenolate component for use in the compositions of the invention.

In a further alternative embodiment for formation of the sulfurized overbased calcium alkylphenolates the initial contact of alkylphenol of formula (I) and calcium alkoxyalkoxide of formula (II) is effected at 50° F. to 425° F. and the sulfurization of the second step is thereafter undertaken at a temperature of between 400° F. and 410° F. The neutralization with calcium alkoxyalkoxide is also accomplished in a single step. The calcium alkoxyalkoxide employed is normally half-carbonated, additionally, using $CO_2$gas. The resulting sulfurized normal calcium alkylphenolate is then overbased by the further sequence that comprises stripping of the sulfurized product, with completion thereafter of the fourth and fifth reaction steps in the same manner, including hydrolysis, stripping, and filtration, as described hereinabove with respect to the preferred overbased embodiment.

The sulfurized normal calcium alkylphenolates so produced, where employed, for example, with an overbased alkaline earth metal hydrocarbyl sulfonate in the practise of the invention, is introduced into the finished blend desirably as a 40 percent to 70 percent, more desirably, 45 percent to 55 percent, and preferably as a 50 percent by weight concentration of the foregoing hydrocarbon diluent oil. The actual concentration is not critical if the alkylphenolate is used immediately and in the same location, since the diluent oil is used, as noted elsewhere herein, as a convenient vehicle for storage and transportation and the alkylphenolate. The preparation of sulfurized normal calcium alkylphenolate is, in any event, complete. For the purpose of preparing the overbased compositions having particular relevance to this invention, that is, sulfurized overbased calcium alkylphenolate and the sulfurized and chlorinated alkylphenolate derivative; additional and different sequences of steps are necessary.

Thus, in preparing the hydroxy chlorinated, alkylphenyl sulfide additive, the sulfurized normal calcium alkylphenolate is further treated, after stripping of the "third reaction product mixture," as it is termed, in the preferred embodiment, or the stripped normal sulfurized calcium alkylphenolate of the alternative embodiment, by addition of dilute sulfuric acid at ambient temperature and pressure. The sulfurized normal calcium alkylphenolate reacts with the dilute aqueous sulfuric acid to yield a sulfurized alkylphenolate (III) and calcium sulfate, as shown in the structural representation of this reaction sequence appearing hereinbelow. The calcium sulfate is removed after precipitation and the dilute sulfuric acid added until this precipitation is completed. The resulting sulfurized alkylphenolate or bis (2-hydroxy-alkylphenyl) sulfide (IV) is then treated in a fifth reaction product mixture with chlorine, at room temperature and at atmospheric pressure in an inert organic solvent, such as benzene, and in the absence of light, to yield bis(-2-hydroxy-3-chloro alkylphenyl) sulfides (V), as also shown in the reaction sequence appearing below.

The reaction sequence commencing with the sulfurized normal calcium alkylphenolate of the "third reaction product mixture" and proceeding through the fourth and fifth reaction products is thus theorized to be as follows:

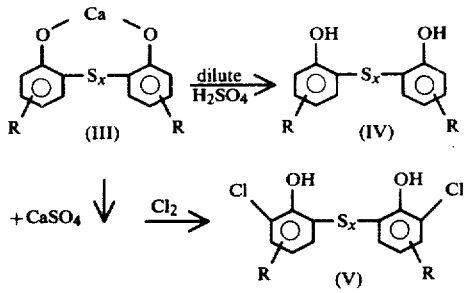

In the formulae of the foregoing visual representation R is as represented hereinabove, and preferably a monovalent saturated alkyl radical containing 12 carbon atoms disposed in the 5-position with respect to the sulfur moiety and x is an integer of from 1 to 4 inclusive; and predominantly 1. Indeed, it is believed that in the mixture of sulfide represented by the formula V the quantity of sulfide wherein x is an integer greater than 1, is less than 5 percent by weight of the total sulfide reaction product. This sulfide or mixture of sulfides, imparts to lubricant oil compositions for use in railway diesel engines having the requisite TBN of at least 10, provided by the overbased sulfurized calcium alkylphenolate or overbased alkaline earth metal hydrocarbyl sulfonate, the silver protective properties required of these lube oils.

The sulfurized, chlorinated alkylphenolate, or chlorinated alkylphenol sulfide, so derived, is then introduced into the finished dilute lubricant oil in an amount by weight of 0.25 percent to 20 percent and preferably 1.0 wt.% to 2.0 wt.%.

The overbased sulfurized calcium alkylphenolate for use herein, characterized by a calcium metal to alkylphenolate ratio of at least 2.9:2, is as indicated hereinabove, also derived by further treatment of the sulfurized normal calcium alkylphenolate, preferably commencing with the "third reaction product mixture" of the preferred embodiment, after stripping thereof, and before addition of further diluent oil. The normal sulfurized alkylphenol secured by the less preferred route or sequence of steps is also utilized however. This further treatment also involves formation of a fourth reaction mixture incorporating the sulfurized normal calcium alkylphenolate of the third product mixture and a further amount of calcium alkoxyalkoxide in a ratio within the range of 1 to 2 moles, and preferably 2 mole, of calcium alkoxyalkoxide per mole of sulfurized calcium alkylphenolate; that is, from 100 wt.% to stoichiometric, to provide a crude mixture of the desired overbased sulfurized calcium alkylphenolate having a calcium metal value per mole of at least 2.9, and preferably 3. In this latter stage, additional hydrocarbon lubricating oil diluent is also advantageously added bringing the total hydrocarbon oil diluent content in the third stage to about 40 to 70, preferably about 45 to about 55, and most desirably about 50, weight percent of the fourth stage reaction mixture.

The latter, or fourth reaction, is undertaken at 370° C. and under conditions otherwise similar to those utilized in the third and immediately preceding reaction. The fourth reaction product is again stripped by continued nitrogen flow at a gas rate between about 0.25 SCFH/gallon and about 0.6 SCFH/gallon at a temperature between about 302° F. and 392° F. to remove the volatile materials present. The stripped fourth reaction mixture is then contacted with water in a fifth reaction stage for a period of time, e.g., between about 0.1 and 10 hours, and preferably between about 2 and 4 hours, at a temperature between about 50° F. and 482° F., (preferably between 300° F. and 400° F.) utilizing a mole ratio of water to calcium alkoxide reactant of between about 100:1 and 0.2:1 while simultaneously blowing the reaction mixture with nitrogen gas at a rate of between 0.1 and 0.2 SCFH/gallon; preferably about 0.15 and 0.2 SCFH/gallon. The water in the contacting may be either in its liquid or vapor form or mixtures thereof, and the contacting with water is continued until the overbased sulfurized calcium alkylphenolate is between about 20% and 70% hydrolyzed.

The water of the foregoing hydrolysis step is introduced preferably into the liquid reaction mixture at the bottom of the reactor as steam and passed therethrough. At the completion of the hydrolysis step the residual unreacted water is, desirably, substantially removed from the final reaction mixture, e.g., by stripping with nitrogen gas at a temperature between about 300° F. and 400° F. and at a rate of between about 0.25 and 0.60 SCFH/gallon. The term "substantially removed" is, in relation to the water present, intended to denote removal of water to the extent that less than 1 wt.% thereof by weight of the total fourth reaction product mixture remains.

It is to be noted that the extent of hydrolysis is dependent on time, temperature and reactant ratios, therefore, period sampling and analysis is necessary to determine the extent of hydrolysis. As a practical matter, once the amount of hydrolysis is decided upon, the particular set of conditions necessary to produce the desired degree of hydrolysis can be determined for a given reactor, obviating the need for periodic sampling.

In the foregoing procedure, it is theorized that the calcium alkoxyalkoxide complexes with, or is dispersed by, the sulfurized normal calcium alkylphenolate and the water hydrolyzes a portion of the complex calcium alkoxyalkoxide moiety with about 50% hydrolysis of said moiety being optimum in respect to stability of the product at high metal ratios.

The hydrolyzed product mixture is treated with carbon dioxide passed through the reaction mixture at a gas rate of 0.1 to 10 SCFH/gallon for a period of about 2 to 4 hours to convert, it is believed, the excess of calcium present as calcium hydroxide to calcium carbonate which is retained in the product mixture and encompassed within the term "overbased" in describing the calcium alkylphenolate product employed in the finished lubricant compositions of the invention. The inert gas normally and preferably employed is nitrogen with a purity of at least 99wt. %.

The rate of blowing with inert gas during overbasing, stripping of the overbased mixture and hydrolysis is significant in determining viscosity. Rates employed outside the recited ranges result in a product of substantially increased viscosity. In regard to the unexpected importance of the use of nitrogen and the rate of introduction thereof, it is theorized that the nitrogen gas coupled with its rate of introduction has a direct effect on particle size of the formed hydrolyzed overbased sulfurized calcium alkylphenolate. One explanation is that a rate higher than the maximum produces particles so fine that they are inadequately coated and they agglomerate resulting in a too viscous product of reduced filterability and also a product which has poor solubility even upon filtration and oil dilution. It is further theorized that when the nitrogen gas rate is below the minimum set forth, particles are formed that are so large as to also result in an excessively viscous product and one having poor solubility even upon oil dilution. To summarize, nitrogen gas introduced during overbasing, stripping and hydrolysis affects particle size which in turn affects viscosity, filterability and solubility of the final product. To obtain minimum viscosity and maximum filterability and solubility, a particular set of conditions, ingredients and amounts coupled with a defined rate range of nitrogen gas blowing in the overbasing, stripping and hydrolysis phases is normally used.

The nitrogen gas employed has preferably an impurity content (oxygen and carbon dioxide) of less than about 0.5 wt.%.

The desired sulfurized, normal or overbased calcium alkylphenolates, having a calcium metal to alkylphenolate ratio, where normal, of 1:2, or, in the preferred overbased embodiment, of 3:2, or within the range of about 2.9:2 and about 3.5:2, whether realized by one or the other of the foregoing processes, even when purified in the manner described is, in actuality, a complex mixture of many compounds. One hypothetical formula employed in the art to represent this complex mixture is as follows:

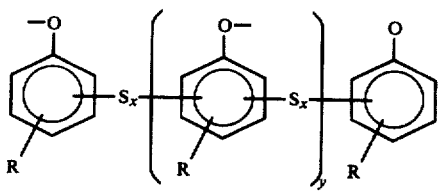

$(1+y/2)Ca \cdot zCO(O-A-OR')_2$ wherein R, R' and A are as heretofore defined, x is an integer from about 1 to 4, y is an average integer of from 0 to 10 and z is an average integer of 0 to about 0.1 when normal sulfurized calcium alkylphenolate prepared as described, illustratively, hereinabove and in Example I hereof, is employed in the practice of the invention; and is an average integer of about 1.9 to about 2.5, and preferably 2, when the overbased sulfurized calcium alkylphenolates, described herein, are used.

The foregoing formula is only set forth as a visual presentation since sulfurized calcium alkylphenolate is in essence a complex mixture of many substances including monosulfides and polysulfides, and therefore, the product can be truly defined only in terms of process. In any case, the R group is believed to be primarily in the para position and the sulfur linked mainly in the ortho position. Further, there is probably also a significant amount of covalent character for the calcium-oxygen bond. It is to be noted that the calcium and sulfur contents of the sulfurized calcium alkylphenolate components are respectively between about 3.5 wt.% and 3.9 wt.% and about .5 wt.% and 12 wt.%.

Illustrative of the alkylphenol reactants contemplated for use herein are 4-octylphenol, 4-t-octylphenol, 2-decylphenol, 2-dodecylphenol, 4-hexadecylphenol, 3,4-didodecylphenol, 2-nonylphenol, 4-triacontylphenol, 4 eicosylphenol and a mixture of decyl and dodecylphenol ($C_{10}$-$C_{12}$ alkylphenol) and a mixture of the 2 and 4 positioned monoalkyl and dialkylphenols. It is to be noted that the alkylphenols employed will normally be p-alkylphenols. The 2,4-disubstituted alkylphenols may also be employed but are generally less preferred.

Examples of the calcium alkoxyalkoxide reactants contemplated herein are calcium 2-methoxyethoxide, calcium 2-methoxypropoxide, calcium 3-methoxybutoxide, calcium 2-ethoxyethoxide and calcium 4-dodecoxyhexoxide. Their corresponding alkoxyethanol diluents are 2-methoxyethanol, 2-methoxypropanol, 2-methoxybutanol, 2-ethoxyethanol and 4-dodecoxyhexanol.

The final overbased alkylphenolate of the fifth stage reaction, including hydrolysis and $CO_2$ treatment may be further purified by standard means, for example by distillation of the diluent and by-products, such as the alkoxyalkanol which is not otherwise removed with the excess water. The product mixture is, in any event filtered, if required, by standard means. The preferred filtration is accomplished by adding to the final mixture between about 0.01 wt.% and 1 wt.% of diatomaceous earth and passing the material to be filtered through a press leaf filter precoated with the foregoing filtration medium at a temperature between 200° F. and 300° F. and at a pressure of 5 to 1000 psig.

The diluent oil remaining upon completion of the fourth reaction is made, as indicated hereinabove, to form lubricant concentrates suitable for transport and storage, of from 40 wt.% to not in excess of 70 wt.% and more desirably from about 45 wt.% to 55 wt.%, and preferably 50 wt.%, containing the sulfurized overbased alkylphenolate and chlorinated sulfurized additive. Suitable diluent base oils include a variety of hydrocarbon lubricating oils such as naphthenic base, paraffinic base and mixed naphthenic and paraffinic base oils having an SUS viscosity at 100° F. of between about 50 and 250 and preferably between about 90 and 150.

The overbased alkaline earth metal sulfonate detergent-inhibitors employed herein are, as indicated above, those wherein a hydrocarbyl moiety is present and the alkaline earth metal is barium, magnesium, or calcium, or indeed, mixtures thereof, but where calcium is the preferred metal. The hydrocarbyl sulfonate of these alkaline metal hydrocarbyl sulfonates is derived from petroleum sulfonates and includes, illustratively, alkyl, alkylaryl, arylalkyl and aryl sulfonates and mixtures thereof containing, in the case of alkyl substituents, from 1 to 24 carbon atoms or more; where aryl moieties are present, from 6 to 24 carbon atoms or more, and alkyl and arylalkyl radicals from 7 to 24 carbon atoms or more. The molecular weight of the product sulfonates is from about 300 to about 1000 normally and preferably about 900. Illustrative of these sulfonates are barium nonylbenzene sulfonate, magnesium dodecylbenzene sulfonate, and calcium octadecylbenezene sulfonate. Where derived as preferred from a petroleum sulfonate mixture in combination with calcium these sulfonates are characterized as calcium alkylbenzene sulfonates having a molecular weight within the foregoing recited range.

These sulfonate detergent additives are calcium (or barium or magnesium) carbonate overbased derivatives formed, illustratively, by blowing a mixture of calcium hydroxide and calcium alkylsulfonate or calcium alkarylsulfonate with carbon dioxide to form a product having a TBN of 50 or more; that is within the range of 50 to 600; more desirably about 280 to 400; and most desirably about 290. The alkaline earth metal carbonate, e.g. calcium carbonate, incorporated in the alkaline earth metal sulfonate present in the lubricant oil mixtures of the invention are embraced, illustratively, by the terms, "overbased alkaline earth metal sulfonates," "overbased alkaline earth metal hydrocarbyl sulfonate," and "overbased calcium sulfonate" and variations thereof employed herein.

These detergent-dispersants are employed in an amount by weight of alkaline earth metal present in the total lubricant oil composition of between about 0.2 percent and about 0.5 percent, and preferably about 0.1 percent to 0.2 percent, the former in the "concentrates" described hereinafter and the latter proportions in the finished dilute lubricant oils of the invention for a total range of 0.1 wt.% to 0.4 wt.%.

The foregoing sulfonates are incorporated with the other additives and base oils recited herein in a naphthenic diluent in an amount by weight of 45 percent to 60 percent, and preferably about 50 percent. This naphthenic oil serves also as a base oil and is the same as those oils specified for use as diluents with the calcium alkylphenolate component defined herein and for use as a base oil in formulating the concentrates and finished lubricant oils of the invention.

The formed sulfurized calcium alkylphenolate product content in lubricating oil compositions contemplated herein range anywhere from 0.1 to 90 wt.%. The higher concentrations, e.g. between about 45 and 55 wt.%, referred to herein as "concentrates" are found normally as, and result directly from, the manufacture of the sulfurized calcium alkylphenolate ingredient. Those concentrates, containing about 0.4 to about 0.1 percent of sulfurized calcium alkylphenolate, expressed as wt.% of calcium by weight of the total lubricant composition employed for railway diesel engine use, are diluted with the lubricant base oil of the finished lubricant oil compositions in a concentration of 0.1 wt.% to 10 wt.% and by weight of calcium from 0.2 wt.% to 0.4 wt.%; for an over-all range based on calcium content of 0.2 wt.% to 1.0 wt.%. The concentrates are, as thus indicated, principally formed for storage and transportation and are subsequently blended to finished oil compositions for engine use.

The concentration of alkaline earth metal, and, as indicated preferably, calcium, of the sulfonate component and the calcium metal concentration of the phenolate in a finished (dilute) lubricating oil prepared according to the practice described herein should, in any event, total at least, and in a significantly preferred embodiment, be, about 0.5 wt.%, and consequently about 0.9 to 1.1% in concentrate form. The concentration employed is sufficient, in any event to effect an alkalinity, manifested as a nominal TBN, of at least 10 to as high as 400 or more; preferably about 10 to 20, and for reasons of economy, most desirably about 10, in the finished (dilute) lubricant oils of the invention.

In forming the sulfurized calcium alkylphenolate employed in the foregoing blend of the present invention the calcium alkoxyalkoxide reactant is introduced in the first, or first and third, and, if overbased, in an additional reaction mixture, usually as a solution, as indicated hereinabove, to facilitate reaction contact. The solvent medium is, as has been noted, usually the corresponding alkoxy-substituted alkanol. The preferred alkoxyalkoxide is calcium methoxyethoxide, and consequently the alkanol is normally 2-methoxyethanol. The concentration of the calcium alkoxyalkoxide in the solvent medium is normally between about 20 wt.% and 60 wt.%. The solvent is conveniently and advantageously removed as overhead effluent during the early phases of each step. Preparation of the calcium alkoxyalkoxide reactant is disclosed, by way of illustration, U.S. Pat. No. 3,706,632.

With respect to the criticalness of the proportions, i.e. 13 wt.% to 20 wt.% of hydrocarbon lubricating oil diluent, in the second, or sulfurized, stage, it is believed that where amounts in excess thereof are used, the oil produces too many sites in competition with the calcium alkylphenolate for the sulfur, with the result that reduced amounts of sulfur attach to the alkylphenol moieties, thus rendering a product more susceptible to oxidative deterioration. It is also theorized that where less than about 13 wt.% of diluent oil is employed in the sulfurization stage, product results having lower sulfur-alkylphenol bonding, since it appears that the reaction is significantly retarded in this instance.

While it is theorized that the efficacy of the overbased sulfurized calcium alkylphenolate employed herein is explained, i part, by the complex mixture of compounds encompassed therein including monosulfides and relatively unstable polysilfides; and the production predominantly of monosulfides at the reaction temperatures of 440° F. to 460° F. in the preferred normal and overbased embodiments recited herein; unstable cleavage products being produced above this range and the unstable polysulfides resulting in increased amounts below this range, no reasonably conclusive explanation is available to explain why the sulfurized calcium alkylphenolate of the invention or, the overbased alkaline earth metal hydrocarbyl sulfonates in combination with the sulfurized and chlorinated alkylphenolates of the invention, as characterized herein, permits the superior silver protection properties inherent in the finished alkaline lubricant compositions of the invention.

In the finished lubricating oil composition, other additives may be included such as supplementary dispersants, pour depressors, antioxidants, viscosity index improvers, oleogenous agents, antifoamants and mixtures thereof.

Supplemental additives which are desirably included in the lubricant compositions of the invention having particular application to railway diesel engines are ethoxylated inorganic phosphorus acid free, steam hydrolyzed, polybutene-$P_2S_5$ reaction products further described in U.S. Pat. Nos. 3,272,744; 3,087,956; and 3,123,630, included herein by reference. These supplementary dispersants appear to cooperate with the subject overbased sulfurized calcium alkylphenolate and sulfurized base oil to enhance detergency and thermal stability and resistance to undesired oxidative decomposition. The ethoxylated product is present in the finished compositions of the invention in amounts between 0.3 and 10 wt.% (oil free basis), preferably between about 0.8 and 4 wt.%, and in any case in sufficient amount to give a phosphorus content in the finished (dilute) compositions of between about 0.01 and 0.08 wt.%.

The foregoing supplemental ethoxylated phosphorus containing detergent-dispersant is prepared by first reacting a polybutene of a molecular weight of between about 800 and 2500 wherein the reaction occurs with about 5 to 40 wt. % $P_2S_5$ at an elevated temperature of between about 212° F. and 600° F. in non-oxidizing atmosphere, e.g., nitrogen, followed by hydrolysis of the resulting product by contact thereof with steam at a temperature between about 212° and 500° F. The steam treatment of the $P_2S_5$ - polybutene reaction product results in its hydrolysis to form inorganic phosphorus acids in addition to the hydrolyzed organic product. Hereinbefore and hereinafter the term "polybutene" denotes derivatives of isobutene as well as butene. The inorganic phosphorus acids are removed from the hydrolyzed product prior to reaction with alkylene oxide by means of standard procedures such as those disclosed in U.S. Pat. No. 2,987,512 and U.S. Pat. No. 2,951,835 wherein removal is effected by contact with, for example, synthetic hydrous alkaline earth metal silicates. Inorganic phosphorus acids can also be removed by extraction with anhydrous methanol as disclosed in U.S. Pat. No. 3,135,729. The steam hydrolyzed organic phosphorus acid product is then contacted with ethylene oxide at a temperature between about 140° and 300° F. under pressure ranging form 0 to 50 psig utilizing a mole ratio of ethylene oxide to hydrolyzed hydrocarbon $P_2S_5$ reaction product of between about 1:1 and 4:1, preferably between about 1.1: and 1.5:. Excess of ethylene oxide is removed after completion of the reaction by blowing the reaction mixture at an elevated temperature, generally with inert gas such as nitrogen. The foregoing reactions are conducted in the presence of a hydrocarbon lubricating oil of the kind used as a diluent in preparation of the sulfurized overbased calcium alkylphenolate of the invention. The lubricating oil normally constitutes between about 20 to 80 wt.% of the reaction mixture. The introduction of the hydrocarbon lubricating oil normally takes place subsequent to steam hydrolysis. The ethoxylated derivate, on an oil free basis, normally has a sulfur content of between about 2 and 5 wt.% and a phosphorus content of between about 4 and 6 wt.%.

Specific examples of the ethoxylated derivative of the foregoing steam hydrolyzed polybutene-$P_2S_5$ reaction products, free of inorganic phosphorus containing acids, are ethoxylated, steam hydrolyzed, polyisobutene (1100 molecular weight, -$P_2S_5$ reaction product; ethoxylated, steam-hydrolyzed polybutene (1500 m.w.)-$P_2S_5$ reaction product; ethoxylated, steam-hydrolyzed polybutene (800 m.w.)-$P_2S_5$ reaction product, and ethoxylated, steam hydrolyzed, polyisobutene (2000m.w.)-$P_2S_5$ reaction product. The ethylene oxide component and the reaction product component are present in each of the foregoing compositions in a mole ratio of 1:1.

Other supplementary detergent dispersants, employed as alternatives to the aforedescribed ethoxylated, steam hydrolyzed, polybutene $P_2S_5$ reaction products, are the $C_{50}$–$C_{200}$ alkenyl succinimide derivatives of alkylene polyamines of the type described in U.S. Pat. No. 3,172,892 and U.S. Pat. No. 3,210,383. These alternative supplementary succinimide detergents are characterized by the formula:

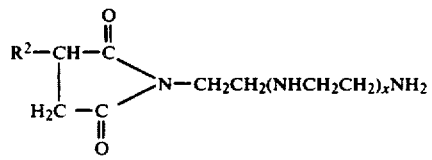

wherein $R^2$ is alkenyl of from 50 to 2000 carbons and x is an integer of from 0 to 10. Particularly suitable examples are whe $R^2$ is polyisobutylene of a molecular weight of about 1000 to 1500 and x is 4 or 5 and mixtures thereof.

Like the foregoing polybutene-$P_2S_5$ derivative, this succinimide detergent appears to complement the sulfurized compositions of the invention to enhance their detergency, thermal stability and resistance to undesired oxidative decomposition. The succinic anhydride derivative is present in the finished composition of the invention on a neat basis of between 1.0 and 10 wt.% and in sufficient amount to give a nitrogen content in the finished (dilute) composition of between about 0.01 and 0.12 wt.%, preferably between about 0.015 and 0.3 wt.%.

Still another additive which may be included in the compositions of the invention in addition to the foregoing supplementary detergents are the 2,5-bis-$C_5$–$C_{20}$ alkyldithio thiodiazoles, such as 2,5-bis(octyldithio)-thiadiazole, which function as antioxidants, sulfur scavengers and antiwear agents. The dithiothiadiazoles are advantageously employed in an amount of between 0.01 and 1 wt.% and preferably between 0.02 and 0.1 wt.% of the finished oil composition.

A still further specific additive which is advantageously included along with the supplementary detergent and antioxidant is the polymeric dimethyl silicone antifoamant. The silicone polymers are desirably employed in amounts of about 100 to 1000 ppm.

The present invention is further illustrated by the following examples, which are not, however, to be construed as limitations thereof. In these examples, as in the remainder of this specification, all references to "parts" or "percentages" are references to parts or percentages by weight unless otherwise expressly indicated.

EXAMPLE I

This example illustrates the preparation of the product of the invention. Throughout the procedure described hereinafter, including each of the steps described, nitrogen blowing of the reaction mixture was conducted at 500 cubic centimeters per minute (cc/min.), unless blowing with $CO_2$ is specified.

(a) A sulfurized normal calcium 4-($C_{12}$–$C_{14}$) alkylphenolate additive was prepared for use in a lubricant oil in accordance with the practise of the invention in the following manner:

To a 50 gallon reactor fitted with a variable speed stirrer and means for heating, collecting volatile overhead and purging with gases, there was charged 124 lbs. (0.42 mole) of 4-($C_{10}$–$C_{12}$) alkylphenol and 120 lbs. of paraffinic base lubricating oil having an SUS viscosity at 100° F. of about 100. The resultant mixture was heated from ambient to 329° F. over a period of 2 hours while passing nitrogen therethrough at a rate of 0.1 s.c.f.h./lb. mixture. At this point, 106 lbs. (0.21 mole) of a 38 wt. percent calcium 2-methoxyethoxide in methoxyethanol were added an the temperature and nitrogen blowing was continued over a period of an additional 2.5 hours while distilling off methoxyethanol solvent and by-product. At the end of the 2.5 hour period there was charged to the residue 16.8 lbs. (0.525 mole) of a 46 wt. percent sulfur in a lubricating oil slurry, said lubricating oil having a viscosity of about 100 SUS at 100° F., and the temperature was raised to and maintained at 356° F. for a period of 4 hours with $N_2$ continuing at a rate of 0.1 s.c.f.h./lb. Then for dedorization 6 lbs. of $CO_2$ were blown in over 4 hour period, followed by $N_2$ at 0.4 s.c.f.h./lb. for 1hour. The stripped mixture was filtered through a pressure filter at 284° F. under 10 p.s.i. utilizing 2.8 lbs. diatomaceous filter aid. The recovered filtrate (280 lbs.) gave the following analysis

TABLE I

| Test: | Result |
|---|---|
| Calcium, wt. percent | 2.95 |
| Sulfur, wt. percent | 2.7 |
| TBN[1] ($HClO_4$ titration) | 81.4 |
| Specific gravity 60/60 | 0.9715 |
| Viscosity, SUS 210° F. | 127 |
| Flashpoint, °F. | 360 |
| Sulfated ash, wt. percent | 9.7 |

[1]Total base number.

The filtrate was determined to be a lubricating oil solution containing 50 wt. percent sulfurized normal calcium 4-$C_{10}$–$C_{12}$ alkylphenolate having a calcium metal ratio of 1.

(b) To 4500 grams (3.32 moles) of sulfurized normal calcium 4-($C_{10}$–$C_{12}$) alkylphenolate lube oil solution filtrate produced by the foregoing process and 876 grams of diluent oil (100 SUS at 100° F.) there was charged 3776 grams (6.98) moles) of calcium 2-methoxyethoxide solution (that has been previously subjected to blowing with $CO_2$ gas at a rate of 500 cc per minute for a period sufficient to render the reagent half-carbonated) and the resultant mixture was nitrogen blown at a rate of 100 ml./min. while heating to 194° F. The 478 mls. (26.5 moles) of water in 500 mls. of 2-methoxyethanol were continuously introduced into the reaction mixture at 194° F. over a period of ½ hour. The reaction mixture was then nitrogen blown (100 ml./min.) for a period of 2 hours at 194° F., then stripped of excess water and solvent at 356° F. utilizing 500 $N_2$ ml./min. At the end of 3-½ hour period at 356° F. the mixture was filtered through a heated funnel under mild vacuum (18 mm. Hg) utilizing 50 g. diatomaceous earth filter aid.

The filtrate was identified as a lubricating oil solution containing 45 wt. percent overbased sulfurized calcium 4-($C_{10}$–$C_{12}$) alkylphenolate which is about 50% hydrolyzed having a calcium metal to alkylphenolate ratio of 3:2. Further analysis found the following.

TABLE II

| Test: | Result |
|---|---|
| Calcium, wt. percent | 6.9 |
| Sulfur, wt. percent | 2.3 |
| TBN ($HClO_4$ titration) | 186.2 |

(b) A sulfurized normal, calcium 4-dodecylphenolate was prepared and served as an intermediate in the production of the chlorinated and sulfurized alkylphenolate additive for use herein. Preparation was performed as follows:

Step 1. To a 12 liter flask filled with a Dean-Stark trap and an inert gas inlet, there was charged 2800 grams of 4-dodecylphenol at ambient temperatures and the product was heated for a period of 2.5 hours at 330° F. There was then charged 1263 grams (2.8 mole calcium) of a 42.3 wt.% Ca. solution of calcium 2-methoxyethoxide in 2-methoxyethanol over a period of 1hour and the methoxyethanol together with other volatile by-products materials were stripped off for a period of 4.5 hours during which time the temperature was raised from 330° F. to 410° F.

Step 2: To the calcium alkylphenolate reaction mixture of Step 1, there was charged over an hour period a sulfur slurry (4200 grams sulfur + 500 grams naphthenic oil of an SUS viscosity of about 110° at 100° F.) while maintaining the temperature at 410° F. Subsequently, the resultant mixture was heated over an hour period from 410° F. to 450° F. and maintained at 450° F. for an additional 6 hours, followed by $CO_2$ blowing (500 ccs/minute) for a 1 hour period at 450° F. and then nitrogen blowing was reinstituted for an additional hour at that temperature.

Step 3: The sulfurized reaction mixture of Step 2 was cooled to 350° F. over an hour period and an additional 2630 grams of the aforedescribed naphthenic lube oil was added and the resultant diluted mixture was reheated over a ⅔ hour period from 280° to 330° F. At the end of the reheating period, an additional 1263 grams (2.8 mole calcium) of a 42.3 wt.% solution of calcium 2-methoxyethoxide in methoxyethanol were added over an hour period at 330° F. Subsequently, the resultant reaction mixture is nitrogen stripped to remove methoxyethanol solvent and volatile by-products over a period of four hours while during that period the temperature is raised from 330° F. to 410° F.

This product, sulfurized substantially normal calcium dodecylphenolate, accords with that described in U.S. Pat. No. 3,969,235 and prepared particularly in Example I thereof.

(c) To 1 mole of stripped sulfurized normal calcium dodecylphenolate prepared in Steps 1, 2 and 3 of Example 1 (b) was added 1000 parts of heptane. Repeated contact with this solution was made by sulfuric acid until no further $CaSO_4$ precipitate appeared. The resulting product solution was washed with water until neutral, whereupon the heptane solution containing the product sulfurized phenol was dried over anhydrous $Na_2SO_4$.

To 0.5 mole of the sulfurized alkylphenol in 50 parts of benzene was then added chlorine at room temperature and in the absence of light. The resulting sulfurized and chlorinated alkylphenol was found to contain 1.7 wt.% of chlorine and 2.7 wt.% of sulfur and is embraced by the designation, bis(2-hydroxy-3-chloro-5-dodecylphenyl) sulfide (or, expressed alternatively, 2,2'-dihydroxy-3,3'-dichloro-5,5'-didodecyl diphenyl)-sulfide wherein the sulfide is predominantly monosulfide.

(d) A particularly useful sulfurized overbased calcium alkylphenolate having a calcium metal to alkylphenolate ratio of 3:2 is prepared as follows:

To a stripped sulfurized normal calcium dodecylphenolate product prepared as described in enumerated Steps 1 to 3 hereinabove was added in a further fourth step 0.5 mole of calicum 2-methoxyethoxide in a 42.3 wt.% solution of calcium 2-methoxyethoxide in methoxyethanol. The addition was completed over a period of one hour at 330° F. Thereafter stripping of the reaction mixture with nitrogen was permitted to continue for about 5.5 hours.

In a concluding fifth step water was introduced into the reaction mixture containing 2:1 calcium alkyoxyalkoxide to sulfurized calcium alkylphenolate as steam at a temperature of about 247°F. for a period of 2.2 hours while nitrogen blowing was continued at a decreased rate of 250 SCFH/gallon (with a variation in rate of 0.1 to 0.2 SCFH/gallon) with nitrogen. The foregoing hydrolysis was succeeded by one in which the nitrogen blowing was increased to a rate of 900 SCFH/gallon (with a variation in this rate of 0.25 to 0.6 SCFH/gallon) for a further period of six hours. At the end of this time span, nitrogen blowing was stopped and the reaction mixture was blown with carbon dioxide at a rate of 100 SCFH/gallon, for a period of 4 hours while maintaining the temperature at 347° F. At the end of this time, nitrogen blowing was resumed to strip excess $CO_2$ from the reaction mixture. The resulting sulfurized overbased calcium alkylphenolate, sulfurized overbased calcium dodecylphenolate, had a calcium metal to alkylphenolate ratio of 3:2 in a concentration of about 50 wt.% in diluent oil. The product was found, upon completion of titration with $HClO_4$, to have a TBN in excess of 175.

The sulfurized overbased calcium 4-($C_{10}$–$C_{12}$) alkylphenolate of Example I(a) and the bis(2-hydroxy-3-chloro-5-dodecylphenyl) sulfide of Example I(c) were incorporated the finished lubricant oils of Formulations A and B of Table I in the amounts indicates therein.

The sulfurized normal calcium dodecylphenolate of Example I(b) was introduced into Formulations C and D of the lubricant oil compositions of Table II appearing hereinafter.

A calcium carbonate overbased hydrocarbyl sulfonate wherein the hydrocarbyl sulfonate is derived from petroleum sulfonates and has a TBN of about 290 and a molecular weight of about 500 was included in Formulations C and D of Table II hereinbelow together with the sulfurized normal calcium dodecylphenolate of Example 1(b) to provide a wt.% of calcium in the amounts indicated in this latter Table and subjected to the tests, with the results, indicated therein.

Admixed with the foregoing additives an the base oil of each of Formulations A, B, C and D of Tables I and II were the supplementary additives 2,5-bis(octyldithio) thiodiazole and an amine dispersant prepared by reaction of approximately equal mole amounts of tetraethylene pentamine and alkenyl succinic anhydride, in which the alkenyl radical is approximately 1200 molecular weight polybutene, in the amounts indicated in Tables I and II to provide the finished lubricant oils of these Tables. Also included in each of the Formulations is an antifoamant, such, for example, as the standard slicone anti-foamant, Dow-Corning "300" in the amount indicated in these same Tables.

Of the foregoing formulations all had TBN's in exces of 10 and gave satisfactory or acceptable test results when subjected to the Union Pacific Oxidation Test ("UPOT") for determination of deterioration under conditions of use in railway diesel engines of these highly alkaline lubricant oils. This deterioration with its attendant formation of sludge, lacquer and resinous materials is reflected in the UPOT by acceptable or unacceptable increases in viscosity. The UPOT involves, specifically, heating each of the oils to be tested for 144 hours at 285° F. with oxygen bubbling at 5 liters per hour in the presence of a Cu-Pb steel bearing strip as catalyst. An acceptable increase in viscosity of a test oil during the test period will not exceed 20 percent.

Formulations A, B, C and D of Table I and Table II, were also subjected, specifically, to the Texaco Modified Silver Disc Test with the results indicated as follows:

TABLE I

| | Formulation | |
|---|---|---|
| | A | B |
| Composition | | |
| Sulfurized overbased Ca dodecylphenolate in 50 wt. % naphthenic carrier oil (Ca %) | 0.2 | 0.2 |
| Alkenyl succinic anhydride (ORONITE 373) (% N) | 0.02 | 0.02 |
| 2,5-Bis(octyldithio) thiadiazole (wt. %) | 0.05 | 0.05 |
| Bis(2-hydroxy-3-chloro-5-dodecylphenyl)sulfide (wt. %) | 2.0 | — |
| Silicone Anti Foamant | 50 ppm | 50 ppm |
| Base oil* | remainder | remainder |
| Test | | |
| Silver Disc Test Visual: | Excellent | Poor |

*Base oil: 2.31% 300 Pale Oil, 54.24% SNO-40, and 43.44% 75/80 Lube Oil.

The Texaco Modified Silver Disc Friction Test (the "Silver Disc Test " of Tables I and II) is a laboratory procedure for determining the silver protective or anti-wear qualities of a lubricant oil. The test machine comprises a system wherein a one-half inch diameter 52100 steel ball is placed in assembly with three one-half inch silver discs of like size and of a quality identical to that employed in the silver pin insert bearing of railway diesel engines manufactured by the Electromotive Division (EMD) of General Motors, Inc. These discs are disposed in contact with one another in one plane in a fixed triangular position in a reservoir containing the oil sample to be tested for its silver anti-wear properties. The steel ball is positioned above and in contact with the three silver discs. In carrying out these tests, the ball is rotated while it is pressed against the three discs at the pressure specified and by means of a suitable weight applied to a lever arm. The test results are formulated by reference to the diameters of the scars on the discs, the scar texture, whether scored or smooth, for example, and coloration in a visual rating system using a standard for comparison and a classification of "poor,"-"fair," "good" and "excellent." The rotation of the steel ball on the silver discs proceeds for a period of 30 minutes at 600 revolutions per minute under a 60 kilogram static load. Each oil is tested at 300° F., 400° F., 450° F. and 500° F.

As indicated in Table I, Formulation A incorporating the chlorinated alkylphenol sulfide (chlorinated sulfurized alkylphenolate) additive of the invention imparted significant silver protective properties to the highly alkaline lubricant oils in which it was incorporated. On the other hand, Formulation B, used as a control, identical to Formulation A, but for the omission of chlorinated alkylphenol sulfide additive, demonstrated silver destructive properties unacceptable to a lubricant oil for use in railway diesel engines including silver components.

Similarly in Table II below, where the desired TBN in excess of 10 was secured in each of the test Formulations C and D using a sulfurized normal calcium dodecylphenolate and calcium hydrocarbyl sulfonate, as described in this Example hereinabove, the silver protective properties for both finished lubricant oils (and including the same base oil described in Table I) were shown to be significantly poorer where the chlorinated alkhlphenol sulfide of the invention was omitted in the control sample of Formulation D as contrasted with the otherwise identical sample of Formulation C.

TABLE II

| | Formulation | |
|---|---|---|
| | A | B |
| Composition | | |
| 40 to 50 wt. % nominal 300 TBN overbased calcium hydrocarbyl sulfonate in naphthenic carrier oil (% Ca) | 0.1 | 0.1 |
| Alkenyl succinic anhydride (% N) | 0.02 | 0.02 |
| 50 wt. % normal sulfurized calcium dodecylphenolate in naphthenic carrier oil (% Ca) | 0.3 | 0.03 |
| 2,5-bis(octyldithio) thiadiazole | 0.05 | 0.05 |
| Bis(2-hydroxy-3-chloro-5-dodecyl phenyl) sulfide (wt. %) | 1 | — |
| Silicone anti-foamant | 50 ppm | 50 ppm |
| Base oil | remainder | remainder |
| Test | | |
| Silver Disc Test Visual: | Excellent | Fair |

That the chlorinated alkylphenol sulfide is essential to impart the requisite silver protective properties to the finished oils of high alkalinity for use in railway diesel engines having silver components is manifest from the foregoing test results of Tables I and II of this Example.

It will be evident that the terms and expressions employed herein are used as terms of description and not of limitation. There is no intention, in the use of these descriptive terms and expressions, of excluding equivalents of the features shown and described, or portions thereof, and it is recognized that various modifications are possible within the scope of the invention claimed.

What is claimed is:

1. A lubricating oil composition comprising:

A hydrocarbon base oil of lubricating viscosity having an SUS viscosity at 100° F. of between about 50 and 250;

an effective silver anti-wear amount of a mixture of hydroxy, chlorinated, alkylphenyl sulfides of the general formula:

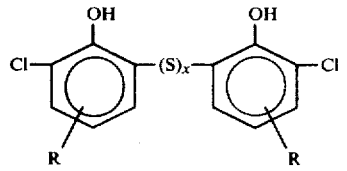

wherein R is, in each instance of its occurrence, one or two alkyl radicals each containing from 4 to 50 carbon atoms, and x is an integer of from 1 to 4, and predominantly 1; and a sulfurized overbased calcium alkylphenolate having a calcium metal to alkylphenol ratio of at least 2.9:2 a calcium content by weight of the total composition of between 6 and 7.4 percent, and a sulfur content of between 0.5 percent and 12 percent of the total composition;

wherein said sulfurized overbased calcium alkylphenolate is produced by the step-wise process that comprises:

(1) introducing into contact with an alkylphenol of the formula:

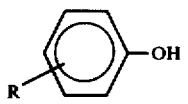

(I)

wherein R is from 1 to 2 monovalent alkyl radicals, each containing from 4 to 50 carbons, a calcium alkoxyalkoxide of the formula:

$$Ca(-O-A-OR')_2 \quad (II)$$

wherein A is an alkanediyl radical from 1 to 6 carbon atoms, and R' is an alkyl radical of from 1 to 25 carbon atoms, at a temperature between 200° F. and 425° F., utilizing a mole ratio of calcium alkoxyalkoxide to said alkylphenol of from 0.5:1 to 0.6:1;

(2) introducing into contact with the resulting reaction mixture, sulfur in the presence of carbon dioxide at a temperature of from 410° F. to 450° F., utilizing a mole ratio of sulfur to initial alkylphenol of between 0.5:1 and 8:1, and a hydrocarbon lubricating oil, said hydrocarbon oil consistuting between about 13 percent and 20 percent by weight of said reaction mixture; to effect incorporation in said alkylphenolate of from 2 percent to 6 percent by weight of sulfur to form sulfurized alkylphenolate, (3) forming a third reaction mixture by further introducing into said sulfurized alkylphenolate a further addition of a calcium alkoxyalkoxide of said formula II in the presence of carbon dioxide at a temperature within said first temperature range in a mole ratio of 0.5:1 to 1:1 of said calcium alkoxyalkoxide to initial alkylphenol; and (4) thereafter hydrolyzing said third reaction mixture, said sulfurized overbased alkylphenolate being employed at a concentration in said lubricating oil composition to give said lubricating oil composition an alkalinity expressed as total base number of at least 10.

2. A lubricant oil composition as claimed in claim 1 where, in said hydroxy chlorinated alkylphenyl sulfide, R is, in each instance of its occurrence, a single monovalent alkyl radical present in the 5 and 5' positions of said phenyl moieties.

3. A lubricant composition as claimed in claim 2 where, in said hydroxy chlorinated alkylphenyl sulfide, R is, in each instance of its occurrence, a dodecyl radical.

4. A lubricant oil composition as claimed in claim 1 wherein there is present in an amount by weight thereof, 0.25 percent to 20 percent of said mixture of hydroxy chlorinated alkylphenyl sulfides.

5. A lubricant oil composition as claimed in claim 4 wherein there is present 1 percent to 2 percent by weight of said mixture of hydroxy chlorinated alkylphenyl sulfides.

6. A lubricant oil composition as claimed in claim 1 wherein said alkylphenol is dodecylphenol.

7. A lubricant oil composition as claimed in claim 1 wherein said calcium alkoxyalkoxide is calcium 2-methoxyethoxide.

8. A lubricant oil composition as claimed in claim 7 wherein said calcium 2-methoxyethoxide is dissolved in methoxyethanol.

9. A lubricating oil composition as claimed in claim 1 wherein said overbased calcium alkylphenolate composition is present in a concentration of about 0.1 percent to about 90 percent by weight of the total lubricant composition.

10. A lubricant oil composition as claimed in claim 9 comprising a concentrate wherein said overbased calcium alkylphenolate composition is present in a concentration of about 45 percent to 55 percent by weight.

11. A lubricant oil composition as claimed in claim 1 wherein said sulfurized calcium alkylphenolate has a calcium metal to alkylphenolate ratio of from 2.9:2 to 3.5:2.

12. A lubricant oil composition as claimed in claim 1 wherein said sulfurized calcium alkylphenolate has a calcium metal to alkylphenolate ratio of 3:2.

13. A lubricating oil composition as claimed in claim 1; and including, additionally, between about 1 percent and 10 percent by weight of a supplementary dispersant selected from the group consisting of (1) an ethoxylated inorganic phosphorus acid-free, steam hydrolyzed polybutene-$P_2S_5$ reaction product having a molecular weight of from 800 to about 2500, said ethoxylated moiety being present in respect to said hydrolyzed polybutene-$P_2S_5$ reaction product in a mole ratio of 1:1; and polybutene and $P_2S_5$ components being present in a mole ratio to one another of about 1:1; and (2) an alkenyl succinic anhydride derivative of an alkylene polyamine characterized by the formula:

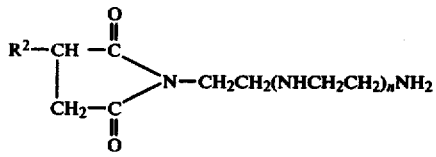

wherein $R^2$ is an alkenyl radical of from 50 to 200 carbon atoms, and n is an integer of from 0 to 10, inclusive.

14. A lubricant oil composition as claimed in claim 13 wherein said supplementary dispersant is an ethoxylated, inorganic phosphorus acid-free, steam-hydrolyzed polybutene-$P_2S_5$ reaction product wherein said polybutene has a molecular weight of about 1200.

15. A lubricant oil composition as claimed in claim 13 wherein said supplementary dispersant is the polybutenesuccinic anhydride derivative of tetraethylene pentamine.

16. A lubricating oil composition as claimed in claim 13 that includes, additionally, between about 0.01 percent and 10 percent by weight of said lubricant composition of an alkyl dithiothiadiazole wherein said alkyl group contains from 5 to 20 carbon atoms.

17. A lubricant oil composition as claimed in claim 16 wherein said alkyl dithiothiadiazole is 2,5-bis(octyldithiothiadiazole).

18. A lubricant oil composition as claimed in claim 1 having a TBN of from about 10 to about 400.

19. A lubricant oil composition as claimed in claim 1 wherein said overbased sulfurized calcium alkylphenolate of the third reaction product mixture is hydrolyzed to between 20 percent to 70 percent.

20. A lubricant oil composition as claimed in claim 19 wherein said overbased sulfurized calcium alkylphenolate of the third reaction product mixture is hydrolyzed to about 50 percent.

* * * * *